US005733718A

United States Patent [19]

Maskasky

[11] Patent Number: 5,733,718

[45] Date of Patent: *Mar. 31, 1998

[54] PHOTOGRAPHIC EMULISIONS IMPROVED BY PEPTIZER MODIFICATION

[75] Inventor: Joe Edward Maskasky, Rochester, N.Y.

[73] Assignee: Eastman Kodak Company, Rochester, N.Y.

[ * ] Notice: The term of this patent shall not extend beyond the expiration date of Pat. No. 5,604,085.

[21] Appl. No.: 662,300

[22] Filed: Jul. 29, 1996

Related U.S. Application Data

[63] Continuation-in-part of Ser. No. 574,834, Dec. 19, 1995.

[60] Provisional application No. 60/002,089 Aug. 10, 1995.

[51] Int. Cl.[6] ..... G03C 1/005; G03C 1/047

[52] U.S. Cl. ..... 430/639; 430/567; 430/569; 430/641

[58] Field of Search ..... 43/567, 569, 639, 43/641

[56] References Cited

U.S. PATENT DOCUMENTS

| | | | |
|---|---|---|---|
| 4,717,650 | 1/1988 | Ikeda et al. | 430/567 |
| 5,284,744 | 2/1994 | Maskasky | 430/569 |
| 5,604,085 | 2/1997 | Maskasky | 430/567 |

OTHER PUBLICATIONS

Mees The Theory of the Photographic Process, Revised Ed., Macmillan, 1951, pp. 48 and 49.

James The Theory of the Photographic Process, 4th Ed., Macmillan, 1977, p. 51.

Research Disclosure, vol. 365, Sep. 1994, Item 36544.

Research Disclosure vol. 176, Dec. 1978, Item 17643.

*Primary Examiner*—Thorl Chea
*Attorney, Agent, or Firm*—Carl O. Thomas

[57] ABSTRACT

A radiation-sensitive silver halide emulsion for use in photographic is disclosed containing an oxidized cationic starch as a peptizer. The oxidized cationic starch facilitates emulsion precipitation and chemical sensitization.

21 Claims, No Drawings

PHOTOGRAPHIC EMULISIONS IMPROVED BY PEPTIZER MODIFICATION

This is a continuation-in-part of application Ser. No. 08/574,834, filed 19 Dec. 1995, which claims priority from Provisional Patent Application 60/002,089, filed 10 Aug. 1995.

FIELD OF THE INVENTION

The invention is directed to photographic emulsions. More specifically, the invention is directed to silver halide emulsions containing modified peptizers.

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

Gelatin and gelatin derivatives form both the peptizer and the major portion of the remainder of the vehicle in the overwhelming majority of silver halide photographic elements. An appreciation of gelatin is provided by this description contained in Mees *The Theory of the Photographic Process*, Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consomme of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling contituents of glue are not present in gelatin. Glue is thus distinguished by its adhesive porperties; gelatin by its cohesive properties, which favor the formation of strong jellies.

> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a prelminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filterered, concentrated if necessary, cooled until it sets, cut up, and dried in slices. The residue, after extraction of the gelatin, consists chiefly of elastin and reticulin with some keratin and albumin.

> Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process*, 4th Ed., Macmillan, 1977, p. 51, states:

> Although collagen generally is the preponderant protein constiutent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure*, Vol. 365, September 1994, Item 36544, II. Vehicles, vehicle extenders, vehicle-like addenda and vehicle related addenda, A. Gelatin and hydrophilic colloid peptizers, paragraph (1) states:

> (1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . .

This description is identical to that contained in *Research Disclosure*, Vol. 176, December 1978, item 17643, IX. Vehicles and vehicle extenders, paragraph A. *Research Disclosure* is published by Kenneth Mason Publications, Ltd., Dudley House, 12 North St., Emsworth, Hampshire P010 7DQ, England.

Maskasky U.S. Pat. No. 5,284,744 taught the use of potato starch as a peptizer for the preparation of cubic (i.e., {100}) grain silver halide emulsions, noting that potato starch has a lower absorption, compared to gelatin, in the wavelength region of from 200 to 400 nm.

RELATED APPLICATIONS

Maskasky U.S. Ser. No. 574,664, filed Dec. 19, 1995, now abandoned in favor of U.S. Ser. No. 08/643,225, filed May 2, 1996, titled HIGH BROMIDE TABULAR GRAIN EMULSIONS IMPROVED BY PEPTIZER SELECTION, commonly assigned, is directed to high bromide {111} tabular grain emulsions in which the peptizer is a water dispersible cationic starch.

Maskasky U.S. Ser. No. 574,833, filed Dec. 19, 1995, titled HIGH BROMIDE ULTRATHIN TABULAR GRAIN EMULSIONS IMPROVED BY PEPTIZER SELECTION, commonly assigned, now U.S. Pat. No. 5,604,085, is directed to high bromide ultrathin {111} tabular grain emulsions in which the peptizer is a water dispersible cationic starch.

Maskasky U.S. Ser. No. 574,489, concurrently filed and commonly assigned, now allowed, titled HIGH BROMIDE ULTRATHIN TABULAR GRAIN EMULSIONS IMPROVED BY PEPTIZER MODIFICATION, is directed to high bromide ultrathin {111} tabular grain emulsions in which the peptizer is a water dispersible oxidized cationic starch.

PROBLEMS TO BE SOLVED

Conventional peptizers obtained from gelatin, cellulose and starch, when employed as aqueous peptizers in forming silver halide emulsions, exhibit levels of viscosity well above the viscosity of water. Further, viscosities increase markedly as temperatures are lowered to approach room temperature (nominally 20° C.), and for this reason silver halide emulsion precipitations are typically undertaken in the temperature range of from 30° to 90° C.

The elevated viscosity levels imparted by these peptizers, even at the elevated temperatures employed for silver halide precipitation, interfere with reactant mixing to obtain uniform grain characteristics. For example, elevated viscosities work against uniform mixing on a microscale (micromixing) which is essential for uniform grain nucleation and growth. Nonuniformity in grain nucleation and, to a lesser extent, growth result in grain polydispersity, including the coprecipitation of grains that differ in their shape and size and, where multiple halides are being coprecipitated, their internal distribution of halides.

On a macroscale the elevated levels of viscosity create difficulties in scaling up the silver halide precipitations to convenient volumes for manufacturing purposes. Elevated levels of viscosity work against being able to sustain desired levels of bulk mixing of reactants as the total volume of the reaction vessel is increased.

The peptizer polymers, being of natural origin, contain mixtures of differing molecules, differing in weight and structure, not all of which are well suited to emulsion preparation. Further, the peptizers exhibit variations based on origin of the starting materials and can vary in composition over time, even when obtained from a single commercial source. Unwanted effects can be seen both in physical properties, such as turbidity, and in sensitometric properties, such as fog.

It is generally accepted that heating of silver halide emulsions is required to achieve chemical sensitization by any one or combination of middle chalcogen (i.e., sulfur, selenium and/or tellurium), noble metal (e.g., gold) or reduction sensitization. For achieve anywhere near maximum acceptable photographic speeds heating to at least about 50° C. is typical, with maximum temperatures being limited only by ambient vapor pressures (e.g., boiling away of the aqueous component). At these elevated temperatures grain ripening is accelerated. This can lead to varied unwanted effects, depending upon the nature of the grains present in the emulsion and their intended end use. Ripening, for example, rounds grain edges and corners of surviving grains, eliminates smaller grains entirely, and can destroy useful grain characteristics (e.g., deleterious thickening of tabular grains can be produced by ripening). Particularly sensitive to unwanted ripening are ultrathin (thickness <0.07 μm) tabular grain emulsions, which can exhibit mean grain thickness increases of in excess of 30 percent (and much higher) when ripening occurs at conventional-chemical sensitization temperatures. Further, elevated temperatures during grain precipitation can also accelerate unwanted ripening and degrade desired grain characteristics.

Finally, the starches that have been heretofore investigated as peptizers have been generally observed to be clearly inferior in their peptizing action. Additionally, conventional peptizers, as demonstrated by Maskasky, cited above, favor the formation of grains having {100} crystal faces, whereas for many applications, particularly those involving high (>50 mole %) bromide silver halide emulsions predominantly {111} crystal faces are desired, such as those found in octahedral, cubo-octahedral and {111} tabular grains.

SUMMARY OF THE INVENTION

In one aspect this invention is directed to a radiation-sensitive emulsion comprised of silver halide grains and a water dispersible starch peptizer wherein the starch peptizer is comprised of an oxidized cationic starch.

It has been discovered quite surprisingly that oxidized cationic starches are better suited for preparing photographic silver halide emulsions than conventional peptizers. Oxidized cationic starches can exhibit lower viscosities and lower viscosities at lower temperatures than conventional peptizers. This facilitates both micro- and macro-scale mixing during emulsion precipitation, counteracting the disadvantages noted above. It allows lower temperatures to be employed during precipitation, which can in turn be used to control unwanted grain ripening during precipitation. Oxidation of the starch peptizer has the benefit of neutralizing deleterious effects of unwanted impurities. Oxidized starches exhibit outstanding levels of optical clarity. Oxidation also intercepts impurities that could otherwise reduce the grains (thereby contributing to fog).

Under comparable conditions of chemical sensitization higher photographic speeds can be realized with oxidized cationic starches. It is possible to achieve comparable levels of chemical sensitization with lesser combinations of sensitizers. In the Examples below sulfur and gold sensitization alone is demonstrated to produce the same levels of sensitivities in oxidized cationic starch peptized emulsions as those achieved by sulfur, gold and reduction sensitization of a conventional gelatino-peptizer control. Lower temperatures can be employed during chemical sensitization of oxidized cationic starch peptized emulsions to achieve photographic speeds equal or superior to those of conventionally peptized emulsions. Oxidized cationic starch peptized emulsions can, in fact, be chemically sensitized at temperatures that are too low to permit the chemical sensitization of gelatino-peptized silver halide emulsions.

Lower temperatures have the advantage of protecting the grains from unwanted ripening, particularly thickening, during precipitation and/or chemical sensitization.

DESCRIPTION OF PREFERRED EMBODIMENTS

Any conventional technique for the precipitation of a photographic silver halide emulsion in the presence of an organic peptizer can be employed in the practice of the invention merely by substituting a water dispersible oxidized cationic starch for the organic peptizer.

The oxidized cationic starch peptizer is hereinafter also referred to as the "selected" peptizer.

The term "oxidized" in referring to starch indicates a starch in which, on average, at least one α-D-glucopyranose repeating unit per starch molecule has been ring opened by cleavage of the 2 to 3 ring position carbon-to-carbon bond.

The term "cationic" in referring to starch indicates that the starch molecule has a net positive charge at the pH of intended use.

The term "water dispersible" in referring to oxidized cationic starches indicates that, after boiling the oxidized cationic starch in water for 30 minutes, the water contains, dispersed to at least a colloidal level, at least 1.0 percent by weight of the total cationic starch.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch (which consists essentially of amylopectin) or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

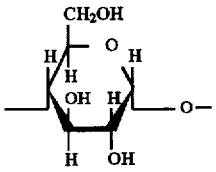

(I)

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

The starch can be oxidized either before (*patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

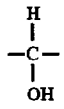

groups are commonly referred to as the glycol groups. The carbon-to-carbon bond between the glycol groups is replaced in the following manner:

(II)

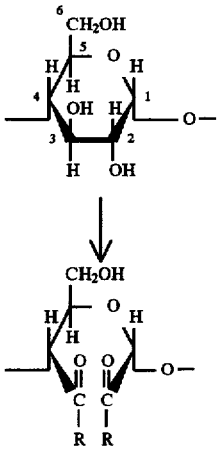

where R represents the atoms completing an aldehyde group or a carboxyl group.

The hypochlorite oxidation of starch is most extensively employed in commercial use. The hypochlorite is used in small quantities (<0.1% by weight chlorine, based on total starch) to modify impurities in starch, most notably to bleach colored impurities. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic or alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplate to add bromide ion to the starch prior to performing the oxidation step in the concentrations known to be useful in the precipitation of silver halide emulsions.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations", *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science*: Part A, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, Starch: *Chemistry and Technology*, Chapter X, Starch Derivatives: Production and Uses, II. Hypochlorite-Oxidized Starches, pp. 315–323, Academic Press, 1984; and O. B. Wurzburg, Modified Starches: *Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidised Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", Tappi, Vol. 47, No. 9, pp. 525–528 (1964); J. E. McCormick, "Properties of Periodate-oxidised Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, Modified Starches: *Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). However, it is generally preferred to avoid driving oxidation beyond levels required for viscosity reduction, since excessive oxidation results in increased chain cleavage. A typical convenient range of oxidation ring-opens from 3 to 50 percent of the α-d-glucopyranose rings.

The water dispersible oxidized cationic starch is present during the precipitation (during nucleation and grain growth or during grain growth) of the silver halide grains. Preferably precipitation is conducted by substituting the water dispersible cationic starch for all conventional gelatino-peptizers. In substituting the selected oxidized cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after grain precipitation has commenced. It is generally preferred that from 1 to 500 grams (most preferably from 5 to 100 grams) of the selected peptizer per mole of silver to be precipitated be present in the reaction vessel prior to grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid grain agglomeration.

The conventional procedures for the precipitation of radiation-sensitive silver halide emulsions employing organic peptizers, such as gelatin, gelatin derivative, starch and cellulose derivative peptizers, modified only by the substitution of oxidized cationic starch in like amounts for the conventional peptizer, can be employed in the practice of the invention. A summary of conventional emulsion precipitations can be found in *Research Disclosure*, Item 36544, cited above, Section I, Emulsion grains and their preparation.

The emulsion grains can be of any conventional halide composition, including silver bromide, silver chloride, silver iodide (including >90 mole percent iodide grains in all possible halide combinations), silver iodobromide, silver chlorobromide, silver bromochloride, silver iodochlorobromide, silver chloroiodobromide, and silver iodobromochloride. Mixed halides are named in order of ascending concentrations.

The grains can vary in size from Lippmann sizes up to the largest photographically useful sizes. For tabular grain emulsions maximum useful sizes range up to equivalent circular diameters (ECD's) of 10 μm. However, even tabular grains rarely have ECD's in excess of 5 μm. Nontabular grains seldom exhibit grain sizes in excess of 2 μm.

In substituting oxidized cationic starch for conventional organic peptizers, a few significant differences can be observed. First, whereas conventionally silver halide precipitations are conducted in the temperature range of from 30° to 90° C., in the preparation of emulsions according to the invention the temperature of precipitation can range down to room temperature or even below. For example, precipitation temperatures as low as 0° C. are within the contemplation of the invention. Unlike conventional peptizers such as gelatino-peptizers, oxidized cationic starch does not "set up" at reduced temperatures. That is, the viscosity of the aqueous dispersing medium containing the oxidized cationic starch remains low.

Although oxidized cationic starch is a highly effective peptizer, preventing clumping of silver halide grains as they are formed and grown, use of the selected peptizer does not in all instances result in the formation of grains of the same shape, size and dispersity that would be formed in the presence of the replaced conventional organic peptizer. For example, oxidized cationic starch shows a much greater propensity toward the formation of grains having {111} crystal faces. This, of course, is highly advantageous in substituting oxidized cationic starch for conventional peptizers in emulsion preparations that conventionally produce grains having {111} crystal faces, such as octahedra and tabular grains, including ultrathin (<0.07 μm) tabular grains, having {111} crystal faces. However, in precipitations that require grain growth modifiers to control crystal habit, varied grain characteristics are obtained, depending upon the specific grain growth modifier present.

It is specifically contemplated to substitute an oxidized cationic starch for the starch peptizer employed in Maskasky U.S. Pat. No. 5,284,744, the disclosure of which is here incorporated by reference.

A specifically preferred application for the oxidized cationic starch peptizer is in the preparation of high (>50 mole percent, based on silver) bromide {111} tabular grain emulsions. The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be useful in the practice of the invention, subject to the selected peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;

Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitouet al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 mole percent bromide and optimally at least 90 mole percent bromide, based on silver. Silver bromide, silver iodobromide, silver chlorobromide, silver iodo-chlorobromide, and silver chloroiodobromide tabular grain emulsions are specifically contemplated. Although silver chloride and silver bromide form tabular grains in all proportions, chloride is preferably present in concentrations of 30 mole percent or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent. It is generally preferred that the iodide concentration be less than 20 mole percent. Significant photographic advantages can be realized with iodide concentrations as low as 0.5 mole percent, with an iodide concentration of at least 1 mole percent being preferred.

The high bromide {111} tabular grain emulsions can exhibit mean grain ECD's of any conventional value, ranging up to 10 μm, which is generally accepted as the maximum mean grain size compatible with photographic utility. In practice, the tabular grain emulsions of the invention typically exhibit a mean ECD in the range of from about 0.2 to 5.0 μm. Tabular grain thicknesses typically range from about 0.03 μm to 0.3 μm. For blue recording somewhat thicker grains, up to about 0.5 μm, can be employed. For minus blue (red and/or green) recording, thin (<0.2 μm) tabular grains are preferred.

Ultrathin (<0.07 μm) tabular grains are specifically preferred for most minus blue recording in photographic elements forming dye images (i.e., color photographic elements). An important distinction between ultrathin tabular grains and those having greater (≧0.07 μm) thicknesses resides in the difference in their reflective properties. Ultrathin tabular grains exhibit little variation in reflection as a function of the wavelength of visible light to which they are exposed, where as thicker tabular grains exhibit pronounced reflection maxima and minima as a function of the wavelength of light. Hence ultrathin tabular grains simplify construction of photographic element intended to form plural color records (i.e., color photographic elements). This property, together with the more efficient utilization of silver attributable to ultrathin grains, provides a strong incentive for their use in color photographic elements.

On the other hand, otherwise comparable tabular grain emulsions used to form silver images differing in tabular grain thickness produce colder image tones on processing as tabular grain thickness is increased. Colder image tones are sought particularly in radiographic images, but they are also sought in variety of black-and-white photography applications.

Except for the wavelength dependence of reflectance and image tone, noted above, the advantages that tabular grains impart to emulsions generally increases as the average aspect ratio or tabularity of the tabular grain emulsions increases. Both aspect ratio (ECD/t) and tabularity ($ECD/t^2$) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 μm (preferably less than 0.2 μm and optimally less than 0.07 μm) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

Conventional dopants can be incorporated into the silver halide grains during their precipitation, as illustrated by the patents cited above and *Research Disclosure*, item 36544, cited above, Section I. Emulsion grains and their preparation, D. Grain modifying conditions and adjustments, paragraphs (3), (4) and (5). It is specifically contemplated to incorporate shallow electron trapping site providing (SET) dopants in the grains as disclosed in *Research Disclosure*, Vol. 367, November 1994, Item 36736.

It is also recognized that silver salts can be epitaxially grown onto the grains during the precipitation process. Epitaxial deposition onto the edges and/or corners of grains is specifically taught by Maskasky U.S. Pat. Nos. 4,435,501 and 4,463,087, here incorporated by reference. In a specifically preferred form high chloride silver halide epitaxy is present at the edges or, most preferably, restricted to corner adjacent sites on the host grains.

Although epitaxy onto the host grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure*, Item 36544, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions and peptizer adsorbed to the grain surfaces cannot be removed by washing.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

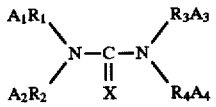

(II)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(III)}$$

wherein

L is a mesoionic compound;

X is an anion; and $L^1$ is a Lewis acid donor.

In another preferred form of the invention it is contemplated to employ alone or in combination with sulfur sensitizers, such as those formula I, and/or gold sensitizers, such as those of formula II, reduction sensitizers which are the 2-[N-(2-alkynyl) amino]-meta-chalcazoles disclosed by Lok et al U.S. Pat. Nos. 4,378,426 and 4,451,557, the disclosures of which are here incorporated by reference.

Preferred 2-[N-(2-alkynyl)amino]-meta-chalcazoles can be represented by the formula:

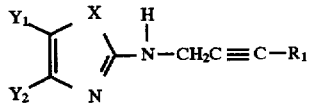

(IV)

where

X=O, S, Se;

$R_1$=(IVa) hydrogen or (IVb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula IV compounds are generally effective (with the IVb form giving very large speed gains and exceptional latent image stability) when present during the heating step (finish) that results in chemical sensitization.

Spectral sensitization of the emulsions of the invention is not required, but is highly preferred, even when photographic use of the emulsion is undertaken in a spectral region in which the grains exhibit significant native sensitivity. While spectral sensitization is most commonly undertaken after chemical sensitization, spectral sensitizing dye can be advantageous introduced earlier, up to and including prior to grain nucleation. Maskasky U.S. Pat. Nos. 4,435,501 and 4,463,087 teach the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. A general summary of useful spectral sensitizing dyes is provided by *Research Disclosure*, Item 36544, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure*, Item 36544, cited above, Section II. Vehicles, vehicle extenders, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Item 36544, Section I. Emulsion grains and their preparation, E. Blends, layers and performance categories. Other common, but optional features are illustrated by *Research Disclosure*, Item 36544, Section VII, Antifoggants and stabilizers; Section VIII, Absorbing and scattering materials; Section IX, Coating physical property modifying agents; Section X, Dye image formers and modifiers. The features of Sections II and VII–X can alternatively be provided in other photographic element layers.

The photographic applications of the emulsions of the invention can encompass other conventional features, such as those illustrated by *Research Disclosure*, Item 36544, Sections:

XI. Layers and layer arrangements
XII. Features applicable only to color negative
XIII. Features applicable only to color positive
XIV. Scan facilitating features
XV. Supports
XVI. Exposure
XVII. Physical development systems
XVIII. Chemical development systems
XIX. Development
XX. Desilvering, washing, rinsing and stabilizing (post-development)

EXAMPLES

The invention can be better appreciated by reference to the following specific examples. Except as otherwise indicated all weight percentages (wt %) are based on total weight. The suffix "C" is used to identify comparative Examples, which fail to satisfy the requirements of the invention. The acronyms "OCS", "CS" and "GEL" are used to indicate oxidized cationic starch (OCS), nonoxidized cationic starch (CS) and gelatin (GEL).

Preparation of Oxidized Cationic Starch

OCS-1

An oxidized cationic starch solution (OCS-1) was prepared by boiling for 30 min a stirred mixture of 80 g cationic potato starch, 27 mmoles of NaBr and distilled water to 4 L. The starch, STA-LOK® 400, was obtained from A. E. Staley Manufacturing Co., Decatur, Ill., and is a mixture of 21% amylose and 79% amylopectin, 0.33 wgt % nitrogen in the form of a quaternary trimethyl ammonium alkyl starch ether, 0.13 wgt % natural phosphorus, average molecular weight 2.2 million.

The resulting solution was cooled to 40° C., readjusted to 4 L with distilled water, and the pH adjusted to 7.9 with solid $NaHCO_3$ (1.2 g was required). With stirring, 50 mL of a NaOCl solution (containing 5 wgt % chlorine) was added along with dilute $HNO_3$ to maintain the pH between 6.5 to 7.5. Then the pH was adjusted to 7.75 with saturated $NaHCO_3$ solution. The stirred solution was heated at 40° C. for 2 hrs. The solution was adjusted to a pH of 5.5. The weight average molecular weight was determined by low-angle laser light scattering to be $>1\times10^6$.

Peptizer Viscosity Comparisons

OCS-2

A 2 percent by weight soluiton oxidized cationic starch, OCS-2, was prepared as described above, except that the final pH of the solution was adjusted to 6.0 (instead of 5.5).

CS-1

A 2 percent by weight soluiton of cationic starch, CS-1, was prepared by boiling for 30 min a stirred mixture of 8 g STA-LOK® 400, 2.7 moles of NaBr and distilled water to 400 mL. The resulting solution was cooled to 40° C., readjusted to 400 mL with distilled water, sonicated for 3 min, and the pH adjusted to 6.0.

GEL-1

A 2 percent by weight solution of gelatin, GEL-1, was prepared using bone gelatin. To 4 L was added 27 moles of NaBr and the pH was adjusted to 6.0 at 40° C.

The kinematic viscosities of these three solutions were measured at various temperatures. The results are given in Table I below.

TABLE I

| | Viscosity (cP) | | |
|---|---|---|---|
| | Temperature | | |
| Solution | 40° C. | 20° C. | 11° C. |
| Water | 0.66 | 1.00 | 1.27 |
| OCS-2 | 1.02 | 1.72 | 2.06 |
| CS-1 | 3.55 | 5.71 | 7.39 |
| GEL-1 | 1.67 | X | X |

X solution solidified.

The viscosity data show that the oxidized cationic starch has the lowest viscosity at low temperatures (less than about 40° C.). This low viscosity makes it particularly desirable for silver halide grain nucleation and/or growth at temperatures below 25° C.

Example 1

AgIBr (3 mole % I) Tabular Grain Emulsion Made Using Oxidized Cationic Starch and a Growth pBr of 2.0

To a vigorously stirred reaction vessel containing 400 g of the oxidized cationic starch solution OCS-2 at 35° C., pH 6.0 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. The pH was adjusted to 6.0 and maintained at this value during the remainder of the precipitation. At 60° C., the $AgNO_3$ solution was added at 1.0 mL per min and the salt solution was added at a rate needed to maintain a pBr of 1.76. After 3 min of precipitation at this pBr, the flow of the salt solution was stopped until a pBr of 2.00 was reached. The $AgNO_3$ solution flow rate was then accelerated to 4 mL per min in 60 min and held at this rate until a total of 0.40 mole of silver had been added. The salt solution was added as needed to maintain a pBr of 2.00.

The tabular grain population of the resulting emulsion was comprised of tabular grains with an average equivalent circular diameter (ECD) of 2.1 μm, an average thickness of 0.08 μm, and an average aspect ratio of 26. The tabular grain population made up 95% of the total projected area of the emulsion grains.

Example 2

AgIBr (3 mole % I) Ultrathin Tabular Grain Emulsion

This emulsion was prepared similarly to Example 1, except that the precipitation was stopped after a total of 0.20 mole of silver was added.

The tabular grain population of the resulting emulsion was comprised of ultrathin tabular grains with an average ECD of 1.7 μm, an average thickness of 0.055 μm, and an average aspect ratio of 31. The tabular grain population made up 95% of the total projected area of the emulsion grains.

Example 3

AgIBr (3 mole % I) Ultrathin Tabular Grain Emulsion

This emulsion was prepared similarly to Example 1, except that the precipitation was stopped after a total of 0.10 mole of the $AgNO_3$ solution was added.

The tabular grain population of the resulting emulsion was comprised of ultra-thin tabular grains with an average ECD of 1.2 μm, an average thickness of 0.040 μm, and an average aspect ratio of 30. The tabular grain population made up 95% of the total projected area of the emulsion grains.

Example 4

AgIBr (3 mole % I) Ultrathin Tabular Grain Emulsion Made Using Oxidized Cationic Starch To a vigorously stirred reaction vessel containing 4 L of the oxidized starch solution OCS-1 at 35° C., pH 5.5 a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 40 mL per min in 30 min and held at this flow rate until a total of 2 moles of silver had been added. The salt solution was concurrently added at a rate needed to maintain a constant pBr of 1.76. The pH was maintained at 5.5 throughout the precipitation.

The resulting tabular grain emulsion was washed by diafiltration at 40° C. to a pBr of 3.38. The tabular grains had an average ECD of 1.1 μm, an average thickness of 0.05 μm, and an average aspect ratio of 22. The tabular grain population made up 95% of the total projected area of the emulsion grains. The emulsion grains had a coefficient of variation in diameter of 21%.

Example 5

AgIBr (3 mole % I) Tabular Grain Emulsion Made Using Oxidized Cationic Starch and a Growth pBr of 1.5

To a vigorously stirred reaction vessel containing 400 g of the oxidized cationic starch solution OCS-2 at 35° C., pH 6.0 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. The pH was adjusted to 6.0 and maintained at this value during the remainder of the precipitation. At 60° C., the $AgNO_3$ solution was added at 1.0 mL per min and the salt solution was added at a rate needed to maintain a pBr of 1.76. After 3 min of precipitation at this pBr, the flow of the silver and salt solutions was stopped and 2.75 mL of a 2.0M NaBr solution was added. The $AgNO_3$ solution flow rate was then accelerated from 1.0 mL per min to 4 mL per min in 60 min and then held at this rate until a total of 0.40 mole of silver had been added. The iodide containing salt solution was added as needed to maintain a pBr of 1.5.

The tabular grain population of the resulting emulsion was comprised of tabular grains with an average ECD of 3.1 μm, an average thickness of 0.07 μm, and an average aspect ratio of 44. The tabular grain population made up 90% of the total projected area of the emulsion grains.

Example 6

AgIBr (3 mole % I) Ultrathin Tabular Grain Emulsion

This emulsion was prepared similarly to Example 5, except that the precipitation was stopped after a total of 0.20 mole of silver was added.

The tabular grain population of the resulting emulsion was comprised of ultrathin tabular grains with an average ECD of 3.0 μm, an average thickness of 0.05 μm, and an average aspect ratio of 60. The tabular grain population made up 95% of the total projected area of the emulsion grains.

Example 7

AgIBr (3 mole % I) Ultrathin Tabular Grain Emulsion

This emulsion was prepared similarly to Example 5, except that the precipitation was stopped after a total of 0.10 mole of the $AgNO_3$ solution was added.

The tabular grain population of the resulting emulsion was comprised of ultra-thin tabular grains with an average ECD of 1.5 μm, an average thickness of 0.040 μm, and an average aspect ratio of 38. The tabular grain population made up 98% of the total projected area of the emulsion grains.

Example 8

AgIBr (3 mole % I) Ultrathin Tabular Grain Emulsion Made Using Oxidized Cationic Starch and Low Temperature Grain Nucleation To a vigorously stirred reaction vessel containing 400 g of the oxidized cationic starch solution OCS-2 at 13° C., and at pH 6.0 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. The pH was adjusted to 6.0 and maintained at this value during the remainder of the precipitation. At 50° C., the $AgNO_3$ solution was added at 1.0 mL per min and the salt solution was added at a rate needed to maintain a pBr of 1.76. After 3 min of precipitation at this pBr, the $AgNO_3$ solution flow rate was accelerated to 4 mL per min in 60 min and held at this rate until a total of 0.40 mole of silver had been added. The iodide containing salt solution was added as needed to maintain a pBr of 1.76.

The tabular grain population of the resulting ultrathin tabular grain emulsion was comprised of ultra-thin tabular grains with an average ECD of 1.8 μm, an average thickness of 0.06 μm, and an average aspect ratio of 30. The tabular grain population made up 95% of the total projected area of the emulsion grains.

Example 9

AgIBr (3 mole % I) Ultrathin Tabular Grain Emulsion Made Using Oxidized Cationic Starch and Low Temperature Grain Nucleation This emulsion was prepared similarly to Example 8, except that the precipitation was stopped after a total of 0.20 mole of silver was added.

The tabular grain population of the resulting emulsion was comprised of ultrathin tabular grains with an average ECD of 1.3 μm, an average thickness of 0.045 μm, and an average aspect ratio of 29. The tabular grain population made up 98% of the total projected area of the emulsion grains.

Example 10

AgIBr (3 mole % I) Ultrathin Tabular Grain Emulsion Made Using Oxidized Cationic Starch and Low Temperature Grain Nucleation This emulsion was prepared similarly to Example 8, except that the precipitation was stopped after a total of 0.10 mole of the $AgNO_3$ solution was added.

The tabular grain population of the resulting emulsion was comprised of ultra-thin tabular grains with an average ECD of 1.0 μm, an average thickness of 0.040 μm, and an average aspect ratio of 25. The tabular grain population made up 98% of the total projected area of the emulsion grains.

Example 11

AgIBr (3 mole % I) Ultrathin Tabular Grain Emulsion Made Using Oxidized Cationic Starch and Low Temperature Grain Nucleation This emulsion was prepared similarly to Example 8, except that the precipitation was stopped after a total of 0.05 mole of the $AgNO_3$ solution was added.

The average thickness was determined by scanning 195 tabular grains using atomic force microscopy to obtain an average tabular grain plus adsorbed starch thickness. The measured starch thickness of 0.0030 μm (the sum of both sides) was subtracted from this value. The corrected average thickness was 0.034 μm. The area weighted equivalent circular diameter was 0.70 μm. The average aspect ratio was 21. The tabular grain population made up 98% of the total projected area of the emulsion grains.

Example 12

AgCl Cubic Grain Emulsion Made Using Oxidized Cationic Starch

An oxidized cationic starch solution was prepared by boiling for 30 min a stirred mixture of 8.0 g cationic potato starch (STA-LOK® 400) in 400 mL of distilled water. The solution was then cooled to 40° C. and sonicated for 3 min. The pH was adjusted to 7.9 using solid $NaHCO_3$. With stirring, 5.0 mL of a NaOCl solution (containing wt % chlorine) was added along with dilute $HNO_3$ to maintain the pH between 6.5 to 7.5. Then the pH was adjusted to 7.75 with saturated $NaHCO_3$ solution. The stirred solution was heated for 3 hr at 40° C. The solution was adjusted to a pH of 5.5 and the volume adjusted to 400 mL with distilled water. Then 50 mmole of NaCl was added.

To a vigorously stirred reaction vessel of the oxidized cationic starch solution that was 0.14 molar in chloride ion, was added a 2M $AgNO_3$ solution first at a rate of 1.0 mL per min for 5 min then at an accelerated rate to reach 4 mL per min in 60 min and then held at this rate until a total of 200 mL of the $AgNO_3$ solution was added. Concurrently, a 2.5M NaCl solution was added at a rate needed to maintained a PCl of 0.89. The pH was maintained at 5.5 during the precipitation.

The resulting emulsion was a cubic grain emulsion comprised of grains having {100} faces. The average grain size (ECD) was 1.5 μm.

Example 13

AgIBr (3 mole % I) Octahedral Grain Emulsion Made Using Oxidized Cationic Starch To a vigorously stirred reaction vessel of 4L of the oxidized starch solution OCS-1 at 70° C. and pH of 5.5, a 2M $AgNO_3$ solution was added at 5 mL per min for 5 min and concurrently, a 2M NaBr solution was added at a rate needed to maintain a pBr of 2.98. After 5 min the addition of the 2M NaBr solution was stopped and a salt solution comprised of 1.94M NaBr and 0.06M KI was added as needed to maintain a pBr of 2.98 for the remainder of the precipitation. The $AgNO_3$ solution was then added at a linearly accelerated rate of from 5 mL per min to 22.5 mL per min in 60 min. After 2 moles of silver were added, the emulsion was cooled to 40° C. and washed by diafiltration maintaining a pBr of between 3.38 and 3.55 by the addition of NaBr solution. After the emulsion was washed with 18 L of distilled water, it was adjusted to a pH of 6.0 and pBr of 3.38.

The resulting emulsion was examined by scanning electron microscopy. It was comprised of well-formed octahedral-shaped grains that were monodispersed in size. The grains had an average edge length of 0.35 μm and an average volume of 0.020 $\mu m^3$.

Control

Example 14

AgIBr (3 mole % I) 3-Dimensional Grain Emulsion Made Using Nonoxidized Cationic Starch A starch solution was prepared by boiling for 30 min a stirred mixture of 80 g of the cationic potato starch STA- LOK® 400 (obtained from A. E. Staley Manufacturing Co., Decatur, Ill.) 4.2 mmoles of NaBr and distilled water to 4 L. The resulting solution at 70° C. was adjusted to a pH of 5.5. To a vigorously stirred reaction vessel of the above solution at 70° C., a 2M $AgNO_3$ solution was added at 5 mL per min for 5 min and concurrently, a 2M NaBr solution was added at a rate to maintain a pBr of 2.98. After 5 min the addition of the 2M NaBr solution was stopped and a salt solution comprised of 1.94M NaBr and 0.06M KI was used to maintain a pBr of 2.98 for the remainder of the precipitation. The $AgNO_3$ solution was then added at a linearly accelerated rate of from 5 mL per min to 22.5 mL per min in 60 min. After 2 moles of silver were added, the emulsion was cooled to 40° C. and washed by diafiltration maintaining a pBr of between 3.38 and 3.55 by the addition of NaBr solution. After the emulsion was washed with 18L of distilled water, it was adjusted to a pH of 6.0 and pBr of 3.38.

The resulting emulsion was examined by scanning electron microscopy. The grains were primarily octahedral, but the grains also had much smaller cubic faces. Thus, the grains were tetradecahedral, but with the {100} faces being relatively restricted in area. The grains had an average octahedral equivalent edge length of 0.35 μm and an average volume of 0.020 $\mu m^3$.

Control

Example 15

AgIBr (3 mole % I) 3-Dimensional Grain Made Using Nonoxidized Noncationic Potato Starch This emulsion was made similarly to that of Example 13, but with these exceptions: In place of OCS-1 solution, a solution of nonoxidized noncationic potato starch was used. The solution was prepared by boiling for 30 min, 80 g of soluble potato starch (obtained from Sigma Chemical Company, St. Louis, Mo.), 27 mmoles of NaBr, and distilled water to 4L. To match average grain volume with Example 13, the precipitation temperature was at 50° C. and, after the $AgNO_3$ solution reached a flow rate of 22.5 mL per min, that flow rate was maintained until the desired volume was achieved. A total of 3.8 moles of silver was added.

The resulting emulsion was comprised of cubic grains having an average volume of 0.020 $\mu m^3$ (diameter of 0.27 μm), and many clumps of two or more grains. The noncationic potato starch was a marginal peptizer.

Control

Example 16

AgIBr (3 mole % I) Ultrathin Tabular Grain Emulsion Made Using a Nonoxidized Cationic Potato Starch A starch solution was prepared by boiling for 30 min a stirred mixture of 80 g cationic potato starch (STA-LOK® 400), 27 mmoles of NaBr, and distilled water to 4 L. The resulting solution was cooled to 35° C., readjusted to 4 L with distilled water, and the pH was adjusted to 5.5. To a vigorously stirred reaction vessel of the starch solution at 35° C., a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The iodide containing salt solution was concurrently added at a rate needed to maintain a constant pBr of 1.76. The resulting tabular grain emulsion was washed by diafiltration at 40° C. to a pBr of 3.38.

The tabular grain population of the resulting tabular grain emulsion was comprised of tabular grains with an average ECD of 1.2 μm, an average thickness of 0.06 μm, and an average aspect ratio of 20. The tabular grain population made up 92% of the total projected area of the emulsion grains. The emulsion grains had a coefficient of variation in diameter of 18%.

Control

Example 17

AgIBr (3 mole % I) Attempted Tabular Grain Emulsion Made Using Oxidized Noncationic Starch This emulsion was prepared similarly to Example 5, except that the starch used was soluble potato starch obtained from Sigma Chemical Company, St. Louis, Mo. The starch was oxidized using the same procedure used for the starch of Example 5.

Clumps of nontabular grains resulted. No tabular grains or isolated nontabular grains were observed. This oxidized noncationic starch failed to peptize the silver halide grains at the high bromide ion concentration generally used to make tabular grain emulsions and particularly the bromide ion concentration (pBr=1.5) used to make Example 5.

Control

Example 18

AgIBr (3 mole % I) Emulsion Precipitation Made Using Oxidized Noncationic Starch An oxidized noncationic starch solution was prepared by boiling for 30 min a stirred mixture of 8.0 g of soluble noncationic potato starch obtained from Sigma Chemical Company, 0.4 mmole of NaBr, and distilled water to 400 mL. The solution was then cooled to 40° C. and the pH was adjusted to 7.9 using solid $NaHCO_3$. With stirring, 5.0 mL of a NaOCl solution (containing 5 wt % chlorine) was added along with dilute $HNO_3$ to maintain the pH between 6.5 to 7.5. Then the pH was adjusted to 7.75 with saturated $NaHCO_3$ solution. The stirred solution was heated overnight at 40° C. The solution was adjusted to a pH of 5.5 and the volume adjusted to 400 mL with distilled water.

To a vigorously stirred reaction vessel of the oxidized noncationic starch solution that was 1.0 mmolar in bromide ion, 40° C. and pH of 5.5, was added a 2M $AgNO_3$ solution at a rate of 0.5 mL per min for 5 min. Concurrently, a 2.0M NaBr solution was added at a rate needed to maintained a pBr of 2.98. After 5 min the addition of the 2M NaBr solution was stopped and a salt solution comprised of 1.94M NaBr and 0.06M KI was added as needed to maintain a pBr of 2.98 for the remainder of the precipitation. The $AgNO_3$ solution was then added at a linearly accelerated rate of from 0.5 mL per min to 2.2 mL per min in 60 min. The emulsion was stopped after 0.2 moles of silver had been added.

The resulting emulsion was examined by optical microscopy and scanning electron microscopy. It was comprised of mostly clusters of grains with only 10% of the grains existing as isolated grains. The grains were polydisperse in size and irregular in shape and having no clearly defined morphology. The average grain had an average ECD of 0.7 μm.

The oxidized noncationic starch was ineffective as a peptizer for this emulsion.

Control

Example 19

AgIBr (2.7 mole % I) Tabular Grain Emulsion

The emulsion was prepared in bone gelatin using published procedures. The emulsion was washed by diafiltration to a pBr of 3.38 at 40° C. The tabular grains had an average ECD of 2.45 μm, an average thickness of 0.06 μm, and an average aspect ratio of 41. The tabular grain population made up 95% of the total projected area of the emulsion grains.

Example 20

Photographic Comparisons

The purpose of this example is to demonstrate the effect on photographic performance of varied peptizers and peptizer combinations.

Emulsions were prepared with five different selections of peptizers introduced before chemical sensitization.

GEL ONLY

The Control Example 19 emulsion was employed. Gelatin was the sole peptizer present through the step of chemical sensitization.

CS+GEL

The Control Example 16 emulsion was employed. As precipitated nonoxidized cationic starch (CS) was present. Before chemical sensitization 25 g of bone gelatin per mole of silver were added.

CS ONLY

The Control Example 16 emulsion was employed. Only nonoxidized cationic starch (CS) was present through the step of chemical sensitization.

OCS+GEL

The Example 4 emulsion prepared using oxidized cationic starch as the peptizer was modified by the addition of 25 g of bone gelatin per mole of silver before chemical sensitization.

OCS ONLY

The Example 4 emulsion was employed. Only oxidized cationic starch (OCS) was present through the step of chemical sensitization.

Chemical Sensitizations

To 0.035 mole of the emulsion sample (see Table II, below) at 40° C., with stirring, were added sequentially the following solutions containing (mmole/mole Ag): 2.5 of NaSCN, 0.22 of a benzothiazolium salt, 1.5 of anhydro-5,5'-dichloro-3,3'-bis(3-sulfopropyl) thiacyanine hydroxide, triethylammonium salt, and 0.08 of 1-(3-acetamido-phenyl)-5-mercaptotetrazole, sodium salt. The pH was adjusted to 5.9. Then varied combinations of the following solutions were sequentially added (mmole/mole Ag): 0.023 of 2-propargylaminobenzoxazole (a reduction sensitizer labeled R in Table II below), 0.036 of 1,3-dicarboxymethyl-1,3-dimethyl-2-thiourea (a sulfur sensitizer labeled S in Table II below), and 0.014 of bis(1,3,5-trimethyl-1,2,4-triazolium-3-thiolate) gold (I) tetrafluoroborate (a gold sensitizer labeled Au in Table II below). The mixture was heated to the temperature given in Table II below at a rate of 5° C. per 3 min, and held at this temperature for 15 min. Upon cooling to 40° C., a solution of 1.68 of 5-bromo-4-hydroxy-6-methyl-1,3,3a, 7-tetraazaindene was added.

The resulting blue spectrally and chemically sensitized emulsions were mixed with gelatin, yellow dye-forming coupler dispersion, surfactants, and hardener and coated onto clear support at 0.84 g/m$^2$ silver, 1.7 g/m$^2$ yellow dye-forming coupler, and 3.5 g/m$^2$ bone gelatin.

The coatings were exposed to blue light for 0.02 sec through a 0 to 4.0 log density graduated step tablet, processed in the Kodak Flexicolor C-41 ™ color negative process using a development time of 3 min 15 sec.

The results are summarized in Table II. The GEL ONLY sample, S+Au+R sensitized at 55° C., was employed as the speed reference and assigned a relative speed of 100, measured at a density of 0.2 above minimum density (Dmin). Each relative speed unit difference between the relative speed of 100 and the reported relative speed represents 0.01 log E, where E represents exposure in lux-seconds. For instance, CS+GEL, sensitized at 55° C., required 0.15 log E less exposure to reach the referenced density of 0.2 above Dmin than GEL ONLY.

TABLE II

Ultrathin Tabular Grain Emulsion Sensitization

| Sample | Sensitizer | Sens. Temp (°C.) | Dmax | Dmin | Mid-Scale Contrast | Rel. Speed |
|---|---|---|---|---|---|---|
| GEL ONLY | S + Au + R | 55 | 3.03 | 0.08 | 2.01 | 100 |
| CS + GEL | S + Au + R | 55 | 2.86 | 0.09 | 1.79 | 115 |
| CS + GEL | S + Au + R | 65 | 3.12 | 0.12 | 1.95 | 198 |
| CS ONLY | S + Au | 45 | 1.03 | 0.04 | 1.70 | 12 |
| CS ONLY | S + Au + R | 45 | 1.55 | 0.05 | 1.71 | 46 |
| CS ONLY | S + Au + R | 55 | 3.18 | 0.13 | 2.08 | 204 |
| OCS + GEL | S + Au | 45 | 1.73 | 0.05 | 2.58 | 23 |
| OCS + GEL | S + Au + R | 45 | 1.93 | 0.05 | 2.40 | 37 |
| OCS ONLY | S + Au | 45 | 3.09 | 0.14 | 2.05 | 192 |
| OCS ONLY | S + Au | 50 | 3.13 | 0.21 | 2.01 | 203 |

*ox = oxidized; cat = cationic; gel = gelatin

Table II shows that, after sensitization, the photographic speed of OCS ONLY, sensitized at relatively low temperatures (45° C. and 50° C.) and without the 2-propargylaminobenzoxazole (R) was far superior to the other emulsions sensitized at similarly low temperatures, even when the propargyl compound (R) was added to boost speed. The presence of gelatin significantly retarded the ability of GEL ONLY, CS+GEL, and OCS+GEL to be effectively sensitized. Only by using higher temperatures for their chemical sensitization did these control emulsions approach the photographic speed of OCS ONLY sensitized at 45° C. and 50° C. OCS ONLY sensitized at 45° C. with S+Au was 1.8 Log E faster than CS ONLY, similarly sensitized. This demonstrates the lower sensitization temperatures that can be employed using an oxidized cationic starch as the sole peptizer.

Example 21

Photographic Performance of Nontabular Grain Emulsions Made and Sensitized with Different Peptizers Samples of the emulsions of Example 13 (oxidized cationic starch peptizer, hereinafter referred to as OCS-NT), Control Example 14 (nonoxidized cationic starch peptizer, hereinafter referred to as CS-NT) and Control Example 15 (nonoxidized noncationic starch peptizer, hereinafter referred to as S-NT) were chemically and spectrally sensitized in the following manner: To 0.035 mole of the emulsion at 40° C., with stirring, were added sequentially the following solutions containing (mmole/mole Ag); 2.5 of NaSCN, 0.22 of a benzothiazolium salt, 0.94 of anhydro-5, 5'-dichloro-3,3'-bis(3-sulfopropyl) thiacyanine hydroxide, triethylammonium salt, and 0.08 of 1-(3-acetamidophenyl) -5-mercaptotetrazole, sodium salt. The pH was adjusted to 5.9. Then the following solutions were sequentially added (mmole/mole Ag) 0.023 of 2-propargylaminobenzoxazole, 0.036 of 1,3-dicarboxymethyl-1,3-dimethyl-2-thiourea, and 0.014 of bis(1,3,5-trimethyl-1,2,4-triazolium-3-thiolate) gold (I) tetrafluoroborate. The mixture was heated to 55° C. at a rate of 5° C./3 min, and held at 55° C. for 15 min. Upon cooling to 40° C., a solution of 1.68 of 5-bromo-4-hydroxy-6-methyl-1,3,3a, 7-tetraazaindene was added.

Sensitometric Comparisons

The resulting blue spectrally and chemically sensitized emulsions were mixed with gelatin, 2-equivalent yellow-forming coupler dispersion, surfactants, and hardener and coated onto a clear support at 0.86 g/m$^2$ silver, 1.9 g/m$^2$ yellow coupler, and 4.3 g/m$^2$ gelatin.

The coatings were exposed to blue light for 0.02 sec through a 0 to 4.0 log density graduated step tablet, processed in the Kodak Flexicolor C-41™ color negative process using a development time of 3 min 15 sec.

The results are summarized in Table III.

TABLE III

Nontabular Grain Emulsion Sensitization

| Sample | Dmax | Dmin | Mid-Scale Contrast | Relative Speed at 0.2 above Dmin |
|---|---|---|---|---|
| S-NT | 2.55 | 0.13 | 1.96 | 100 |
| CS-NT | 1.61 | 0.08 | 0.49 | 91 |
| OCS-NT | 3.11 | 0.09 | 1.82 | 125 |

After sensitization, the photographic speed of emulsion sample of Example 13 (OCS-NT) was far superior to the similarly sensitized Control Example 14 (CS-NT) and Control Example 15 (S-NT). The Example 13 emulsion sample (OCS-NT), made and sensitized in oxidized cationic starch, was 0.25 log E (25 relative speed units=0.25 log E, where E is exposure in lux-seconds) faster than the Control Example 15 sample, made and sensitized in nonoxidized noncationic potato starch.

Example 22

The Effect of Varied Peptizers on Grain Characteristics

This example has as its purpose to compare the grain characteristics tabular grain emulsions as a function of the peptizer chosen.

Emulsion 22A

AgIBr (2.4 mole % I) Tabular Grain Emulsion Made Using Oxidized Cationic Amylopectin Starch, AgBr Nucleation STA-LOK® 140 was obtained from A. E. Staley Manufacturing Co., Decatur, Ill. It is nearly pure amylopectin obtained from the genetic variety of corn known as waxy corn. It was made cationic with 0.35 wg % nitrogen substitution in the form of a quaternary trimethyl ammonium alkyl starch ether, oxidized using 2 wgt % chlorine bleach, and washed. A 2% solution of this starch had a conductivity of 390 μS. Elemental analysis showed it to contain 0.037 wgt % sulfur and 0.008 wgt % phosphorus.

A starch solution was prepared by boiling for 30 min a stirred mixture 8 g STA-LOK ® 140, 2.7 mmoles of NaBr, and distilled water to 400 g. After boiling, the weight was restored to 400 g with distilled water.

To a vigorously stirred reaction vessel of the starch solution at 40° C., pH 5.5, a 2M $AgNO_3$ solution and a 2M NaBr solution were added at 10 mL per min for 0.2 min. The additions were stopped and 5 mL of 2M NaBr solution were dumped in. The temperature was increased to 60° C. in 12 min. After holding at 60° C. for 10 min, the 2M $AgNO_3$ solution was added at 0.5 mL per min for 1 min and then the flow rate was accelerated at a rate of 0.0389 per min until a total of 0.2 mole of silver had been added. Concurrently, a salt solution consisting of 2.01 molar in NaBr and 0.048 molar in KI was added at a rate needed to maintain a pBr of 1.44. The pH was maintained at 5.5 during the precipitation.

The tabular grain population of the resulting tabular grain emulsion was comprised of AgIBr tabular grains with an average equivalent circular diameter of 6.8 μm, an average thickness of 0.07 μm, and an average aspect ratio of 96. The tabular grain population made up 97% of the total projected area of the emulsion grains.

Emulsion 22B

AgIBr (2.4 mole % I) Tabular Grain Emulsion Made Using an Oxidized Cationic Starch Containing a Mixture of Amylose and Amylopectin, AgBr Nucleation An oxidized cationic starch solution (OCS-1A) was prepared by boiling for 30 min a stirred mixture of 32 g cationic potato starch, 11 mmoles of NaBr and distilled water to 1400 g. The starch, STA-LOK ® 400, was obtained from A. E. Staley Manufacturing Co., Decatur, Ill., and is a mixture of 21% amylose and 79% amylopectin, 0.33 wgt % nitrogen in the form of a quaternary trimethyl ammonium alkyl starch ether, and 0.13 wgt % natural phosphorus.

The resulting solution was cooled to 40° C., readjusted to 1400 g with distilled water, and the pH adjusted to 7.9 with solid $NaHCO_3$. With stirring, 20 mL of a NaOCl solution (containing 5 wgt % chlorine) was added along with dilute $HNO_3$ to maintain the pH between 6.5 to 7.5. Then the pH was adjusted to 7.75 with saturated $NaHCO_3$ solution. The stirred solution was heated at 40° C. for 2 hrs. Then the solution was adjusted to 1600 g with distilled water and to a pH of 5.0.

The emulsion was prepared similarly as Emulsion 22A, except that 400 g of 20 CS-1A was used as the starch solution, 400 g of OCS-1A contained 8 g starch and 2.7 mmoles of NaBr.

The tabular grain population of the resulting tabular grain emulsion was comprised of AgIBr tabular grains with an average equivalent circular diameter of 3.0 μm, an average thickness of 0.06 μm, and an average aspect ratio of 50. The tabular grain population made up 96% of the total projected area of the emulsion grains.

Note that a comparison of the tabular grains of Emulsions 22A and 22B revealed a 227% larger average ECD and a 192% greater aspect ratio for Emulsion 22B, prepared with the amylopectin starch peptizer. These increases represent a significant advantage in applications requiring large tabular grains.

Emulsion 22C

AgIBr (2.3 mole % I) Ultrathin Tabular Grain Emulsion Made Using Oxidized Cationic Amylopectin Starch, AgBr Nucleation This emulsion was prepared similarly to Emulsion 22A, except that the precipitation was stopped after a total of 0.1 mole of silver had been added.

The tabular grain population of the resulting ultrathin tabular grain emulsion was comprised of AgIBr tabular grains with an average equivalent circular diameter of 4.0 μm, an average thickness of 0.06 μm, and an average aspect ratio of 67. The tabular grain population made up 98% of the total projected area of the emulsion grains.

Emulsion 21D

AgIBr (2.3 mole % I) Ultrathin Tabular Grain Emulsion Made Using Oxidized Cationic Amylopectin Starch, AgIBr Nucleation This emulsion was prepared similarly to Emulsion 22A, except that instead of 2M NaBr solution, a solution 2.01 molar in NaBr and 0.048 molar in KI was added at 10 mL per min for 0.2 min at the start of the precipitation. A total of 0.2 mole of silver was added.

The tabular grain population of the resulting tabular grain emulsion was comprised of AgIBr tabular grains with an average equivalent circular diameter of 2.16 μm, an average thickness of 0.06 μm, and an average aspect ratio of 36. The tabular grain population made up 97% of the total projected area of the emulsion grains. The tabular grain population had a $COV_{ECD}$ of 46%.

Emulsion 22E

AgIBr (2.4 mole % I) Tabular Grain Emulsion, AgIBr Nucleation

This emulsion was prepared similarly Emulsion 22D, except that the acceleration of the flow rate was continued until a total of 0.3 mole of silver had been added.

The tabular grain population of the resulting tabular grain emulsion was comprised of AgIBr tabular grains with an average equivalent circular diameter of 2.86 μm, an average thickness of 0.08 μm, and an average aspect ratio of 36. The tabular grain population made up 99% of the total projected area of the emulsion grains. The tabular grain population had a $COV_{ECD}$ of 49%.

Emulsion 22F

AgIBr (2.4 mole % I) Ultrathin Tabular Grain Emulsion, AgIBr Nucleation

This emulsion was prepared similarly to Emulsion 22D, except that the precipitation was stopped after a total of 0.1 mole of silver had been added.

The tabular grain population of the resulting tabular grain emulsion was comprised of AgIBr tabular grains with an average equivalent circular diameter of 1.80 μm, an average thickness of 0.04 μm, and an average aspect ratio of 45. The tabular grain population made up 98% of the total projected area of the emulsion grains.

Emulsion 22G

AgIBr (2.5 mole % I) Tabular Grain Emulsion Made Using Oxidized Cationic Amylopectin Starch A starch solution was prepared by boiling for 30 min a stirred mixture of 8 g STA-LOK® 140, 2.7 moles of NaBr, and distilled water to 400 g. After boiling, the weight was restored to 400 g with distilled water.

To a vigorously stirred reaction vessel of this starch solution at 40° C., pH 5.0, a 2M $AgNO_3$ solution and a 2M NaBr solution were added at 15 mL per min for 0.2 min. The additions were stopped and 5 mL of 2M NaBr solution were dumped in. The temperature was increased to 60° C. in 12 min. After holding at 60° C. for 10 min, the 2M $AgNO_3$ solution was added at 0.5 mL per min for 1 min and then the flow rate was accelerated at a rate of 0.0389 per min until a total of 0.2 mole of silver had been added. Concurrently, a salt solution consisting of 2.01 molar in NaBr and 0.048 molar in KI was added at a rate needed to maintain a pBr of 1.44. The pH was maintained at 5.0 during the precipitation.

The tabular grain population of the resulting tabular grain emulsion was comprised of AgIBr tabular grains with an average equivalent circular diameter of 4.05 μm, an average thickness of 0.068 μm, and an average aspect ratio of 60. The tabular grain population made up 97% of the total projected area of the emulsion grains.

Emulsion 22H

AgIBr (2.5 mole % I) Tabular Grain Emulsion (a control) Made Using Oxidized Gelatin This emulsion was prepared similarly to Emulsion 22G, except that oxidized (low methionine) gelatin was substituted for the oxidized starch.

The tabular grain population of the resulting tabular grain emulsion was comprised of AgIBr tabular grains with an average equivalent circular diameter of 3.72 μm, an average thickness of 0.108 μm, and an average aspect ratio of 34. The tabular grain population made up 95% of the total projected area of the emulsion grains.

Note that, comparing the tabular grains of Emulsion 22G and control Emulsion 22H, those of Emulsion 22G had a 159% reduction in thickness and a 176% increase in aspect ratio.

Emulsion 22J

AgBr Tabular Grain Emulsion Made Using Oxidized Cationic Amylopectin Starch

A starch solution was prepared by boiling for 30 min a stirred mixture of 8 g STA-LOK® 140, 2.7 mmoles of NaBr, and distilled water to 400 g. After boiling, the weight was restored to 400 g with distilled water. To this solution was added 14.7 moles of sodium acetate.

To a vigorously stirred reaction vessel of this starch solution at 40° C., pH 5.0, a 2M $AgNO_3$ solution and a 2M NaBr solution were added at 10 mL per min for 0.2 min. The additions were stopped and 5 mL of 2M NaBr solution were dumped in. The temperature was increased to 60° C. in 12 min. After holding at 60° C. for 10 min, the 2M $AgNO_3$ solution was added at 0.5 mL per min for 1 min and then the flow rate was accelerated at a rate of 0.0389 per min until a total of 0.2 mole of silver had been added. Concurrently, a 2M NaBr solution was added at a rate needed to maintain a pBr of 1.44. The pH was maintained at 5.0 during the precipitation.

The tabular grain population of the resulting tabular grain emulsion was comprised of AgBr tabular grains with an average equivalent circular diameter of 3.67 μm, an average thickness of 0.07 μm, and an average aspect ratio of 52. The tabular grain population made up 99% of the total projected area of the emulsion grains. The tabular grain population had a $COV_{ECD}$ of 31%.

Emulsion 22K

Ultrathin AgBr Tabular Grain Emulsion Made Using Oxidized Cationic Amylopectin Starch This emulsion was prepared similarly to Emulsion 22J, except that the precipitation was stopped after a total of 0.1 mole of silver had been added.

The tabular grain population of the resulting tabular grain emulsion was comprised of AgBr tabular grains with an average equivalent circular diameter of 2.90 μm, an average thickness of 0.06 μm, and an average aspect ratio of 48. The tabular grain population made up 97% of the total projected area of the emulsion grains. The tabular grain population had a $COV_{ECD}$ of 24%.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains and a water dispersible starch peptizer wherein the starch peptizer is comprised of an oxidized cationic starch.

2. A radiation-sensitive emulsion according to claim 1 wherein the oxidized cationic starch is comprised of at least one of α-amylose and amylopectin oxidized cationic starch.

3. A radiation-sensitive emulsion according to claim 2 wherein the oxidized cationic starch consists essentially of oxidized amylopectin cationic starch.

4. A radition-sensitive emulsion according to claim 1 wherein the oxidized starch contains cationic moieties selected from among protonated amine moieties and quaternary ammonium, sulfonium and phosphonium moieties.

5. A radiation-sensitive emulsion according to claim 1 wherein the oxidized cationic starch contains α-D-glucopyranose repeating units and, on average, at least one oxidized α-D-glucopyranose unit per starch molecule.

6. A radiation-sensitive emulsion according to claim 5 wherein at least 1 percent of the α-D-glucopyranose units are ring opened by oxidation.

7. A radiation-sensitive emulsion according to claim 6 wherein from 3 to 50 percent of the α-D-glucopyranose units are ring opened by oxidation.

8. A radiation-sensitive emulsion according to claim 6 wherein the oxidized α-D-glucopyranose units contain two —C(O)R groups, where R completes an aldehyde or carboxyl group.

9. A radiation-sensitive emulsion according to claim 8 wherein the oxidized α-D-glucopyranose units are dialdehydes.

10. A radiation-sensitive emulsion according to claim 1 wherein the oxidized cationic starch contains α-D-glucopyranose repeating units having 1 and 4 position linkages.

11. A radiation-sensitive emulsion according to claim 10 wherein the oxidized cationic starch additionally contains 6 position linkages in a portion of the α-D-glucopyranose repeating units to form a branched chain polymeric structure.

12. A radiation-sensitive emulsion according to claim 1 wherein the oxidized cationic starch is dispersed to at least a colloidal level of dispersion.

13. A radiation-sensitive emulsion according to claim 12 wherein the oxidized cationic starch is at least in part present as an aqueous solute.

14. A radiation-sensitive emulsion according to claim 1 wherein the silver halide grains have {111} crystal faces.

15. A radiation-sensitive emulsion according to claim 14 wherein the silver halide grains are tabular grains (a) having {111} major faces, (b) containing greater than 50 mole percent bromide, based on silver, and (c) account for greater than 50 percent of total grain projected area.

16. A radiation-sensitive emulsion according to claim 15 wherein the tabular grains have a mean thickness in the range of from 0.07 to 0.30 μm.

17. A radiation-sensitive emulsion according to claim 1 wherein the peptizer consists essentially of the oxidized cationic starch.

18. A radiation-sensitive emulsion according to claim 17 wherein the grains are chemically sensitized.

19. A radiation-sensitive emulsion according to claim 18 wherein the grains are chemically sensitized with at least one of sulfur, gold and reduction sensitizers.

20. A radiation-sensitive emulsion according to claim 18 wherein a photographic vehicle is combined with the chemically sensitized tabular grains.

21. A radiation-sensitive emulsion according to claim 20 wherein the photographic vehicle includes gelatin or a gelatin derivative.

* * * * *